US007593667B2

(12) United States Patent
Matsushima

(10) Patent No.: US 7,593,667 B2
(45) Date of Patent: Sep. 22, 2009

(54) IMAGE FORMING APPARATUS WITH DETACHABLE PROCESS UNIT

(75) Inventor: Ryoichi Matsushima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 466 days.

(21) Appl. No.: 11/362,118

(22) Filed: Feb. 27, 2006

(65) Prior Publication Data

US 2006/0193674 A1 Aug. 31, 2006

(30) Foreign Application Priority Data

Feb. 25, 2005 (JP) ..... 2005-050917

(51) Int. Cl.
*G03G 21/16* (2006.01)
*G03G 15/00* (2006.01)

(52) U.S. Cl. ..... 399/111; 399/110

(58) Field of Classification Search ..... 399/110, 399/111, 124, 125
See application file for complete search history.

(56) References Cited

U.S. PATENT DOCUMENTS

| | | | | |
|---|---|---|---|---|
| 4,806,977 | A * | 2/1989 | Mizutani et al. | 399/111 |
| 4,888,620 | A * | 12/1989 | Fujino et al. | 399/110 |
| 4,947,208 | A | 8/1990 | Komatsu et al. | |
| 5,298,946 | A * | 3/1994 | Haneda et al. | 399/124 X |
| 5,737,667 | A | 4/1998 | Okuda et al. | |
| 6,674,982 | B2 | 1/2004 | Saitoh et al. | |
| 7,395,008 | B2 | 7/2008 | Sato et al. | |
| 2004/0190934 | A1 | 9/2004 | Okabe | |

FOREIGN PATENT DOCUMENTS

| | | | |
|---|---|---|---|
| JP | 3180863 | | 8/1991 |
| JP | H05-045940 | A | 2/1993 |
| JP | 61471 | | 1/1994 |
| JP | H06-161167 | A | 6/1994 |
| JP | H06-164161 | A | 6/1994 |
| JP | 682245 | | 10/1994 |
| JP | 7219403 | | 8/1995 |
| JP | 850383 | | 2/1996 |
| JP | 11231594 | | 8/1999 |
| JP | H11-352861 | A | 12/1999 |
| JP | 2002108170 | A | 4/2002 |
| JP | 2004-279937 | A | 10/2004 |
| JP | 2004302009 | | 10/2004 |

OTHER PUBLICATIONS

Japan Patent Office, Office Action mailed Oct. 28, 2008 in priority counterpart Patent Application No. JP 2005-050917.
Japanese Patent Office, Reasons for Rejection in Japanese Patent Application No. 2005-050917 (counterpart to above-captioned U.S. patent application) mailed Jul. 1, 2008 (partial translation provided).

* cited by examiner

*Primary Examiner*—Sandra L Brase
(74) *Attorney, Agent, or Firm*—Baker Botts, LLP

(57) ABSTRACT

An image forming apparatus including: a process unit having a developer container for containing a developer; an apparatus main body having an opening and a unit accommodation section into which the process unit is inserted through the opening and detachably accommodated; and a cover for closing the opening in a state that the process unit is accommodated in the unit accommodation section, the cover being integrally provided with the process unit.

13 Claims, 7 Drawing Sheets

IMAGE FORMING APPARATUS WITH DETACHABLE PROCESS UNIT

CROSS REFERENCE TO RELATED APPLICATION

This application claims priority from Japanese Patent Application No. 2005-050917, filed on Feb. 25, 2005, the entire subject matter of which is incorporated herein by reference.

1. Technical Field

Aspects of the present invention relate to an image forming apparatus in which a unit accommodation section that accommodates a process unit is formed so as to have an opening.

2. Background

In image forming apparatus such as laser printers and copiers, expendables such as a photosensitive drum and a developer used therein need to be replaceable. In view of this, conventionally, many kinds of image forming apparatus have been developed that are configured in such a manner that a process unit as a unitized implementation of a photosensitive drum, a developer accommodation room, etc., can be attached to and detached from an apparatus main body of the image forming apparatus. More specifically, a unit accommodation section capable of accommodating a process unit is formed in the apparatus main body so as to have an opening in one wall of the apparatus main body, and a cover for closing the opening is provided so as to be openable. However, this configuration has a problem that replacement of the process unit takes time and labor because an operation of opening the cover and an operation of pulling out the process unit need to be performed independently.

JP-A-2004-302009 discloses a configuration in which a sheet material accommodation member which accommodates sheet materials and which is movable with respect to the apparatus main body is provided integrally with the above-mentioned cover. In this configuration, the opening of the unit accommodation section is also opened when the sheet material accommodation member is pulled out to supply sheet materials to it. This allows process unit replacement work to be performed easily at the same time.

SUMMARY

However, in the configuration disclosed in JP-A-2004-302009, an operation of pulling out the sheet material accommodation member is necessary even in the case of replacing only the process unit. Undue time and labor are required after all.

The present invention provides an image forming apparatus in which an operation of pulling out a process unit can be performed easily.

According to an aspect of the invention, there is provided an image forming apparatus including: a process unit having a developer container for containing a developer; an apparatus main body having an opening and a unit accommodation section into which the process unit is inserted through the opening and detachably accommodated; and a cover for closing the opening in a state that the process unit is accommodated in the unit accommodation section, the cover being integrally provided with the process unit.

In the invention, the image forming apparatus is not limited to a printing apparatus such as a printer (e.g., laser printer) and may be a facsimile machine or a multi-function machine having a printer function, a scanner function, etc.

The process unit is only required to be able to be pulled out of the apparatus main body and maybe such as not to be separated In this configuration, the cover for closing the opening of the unit accommodation section is provided integrally with the process unit. Therefore, the process unit can be pulled out of the unit accommodation section together with the cover by opening the cover to let the opening appear. The efficiency of the operation of pulling out the process unit can thus be increased.

BRIEF DESCRIPTION OF THE DRAWINGS

Illustrative aspects of the invention may be more readily described with reference to the accompanying drawings.

DETAILED DESCRIPTION

<Aspect 1>

A first aspect of the present invention will be described below with reference to FIGS. 1-5.

1. Total Configuration of Aspect

Figure 1:
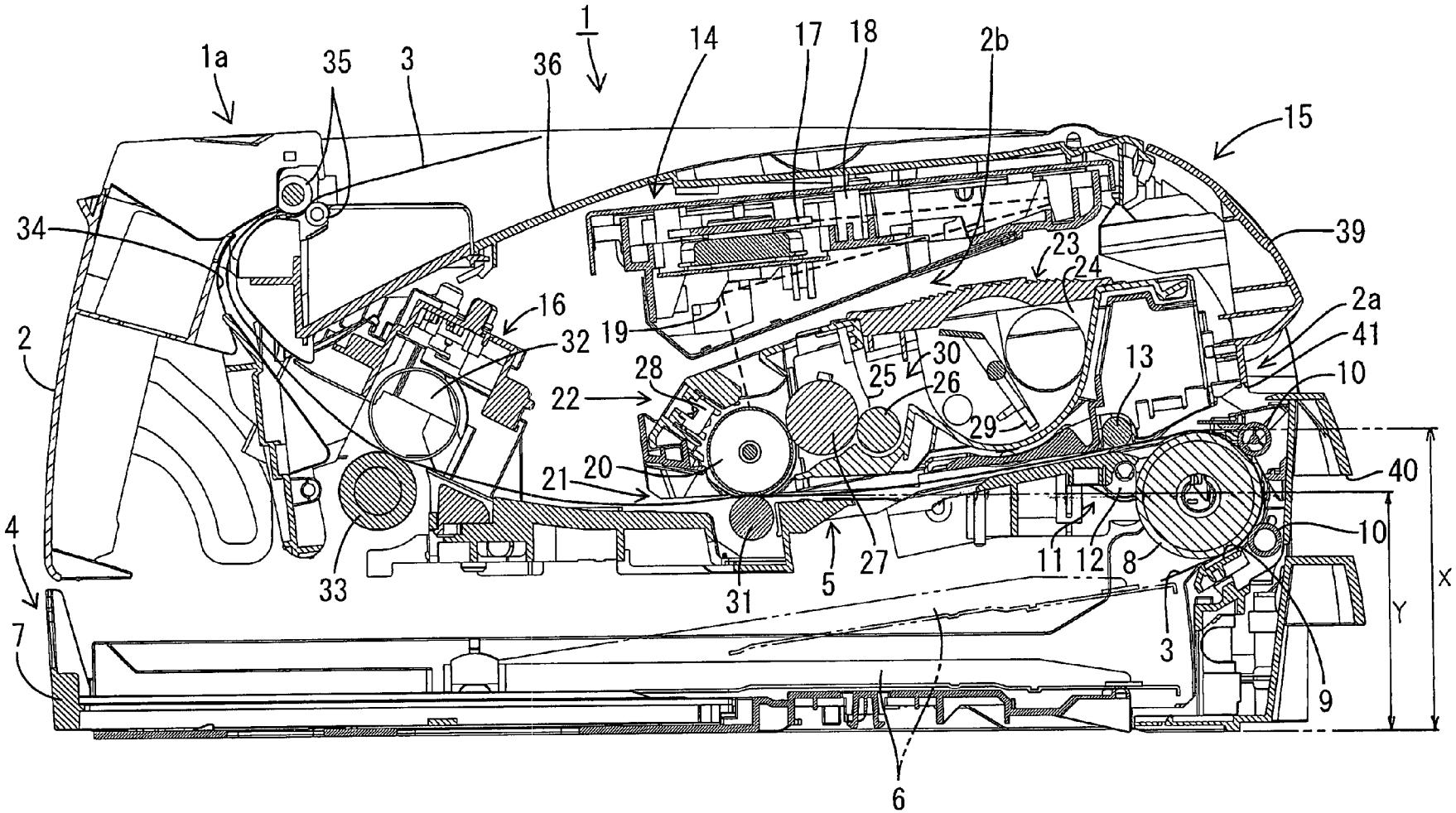
FIG. 1 is a side sectional view of a laser printer according to a first aspect of the present invention (a state that attachment of a process unit has completed)
Figure 2:
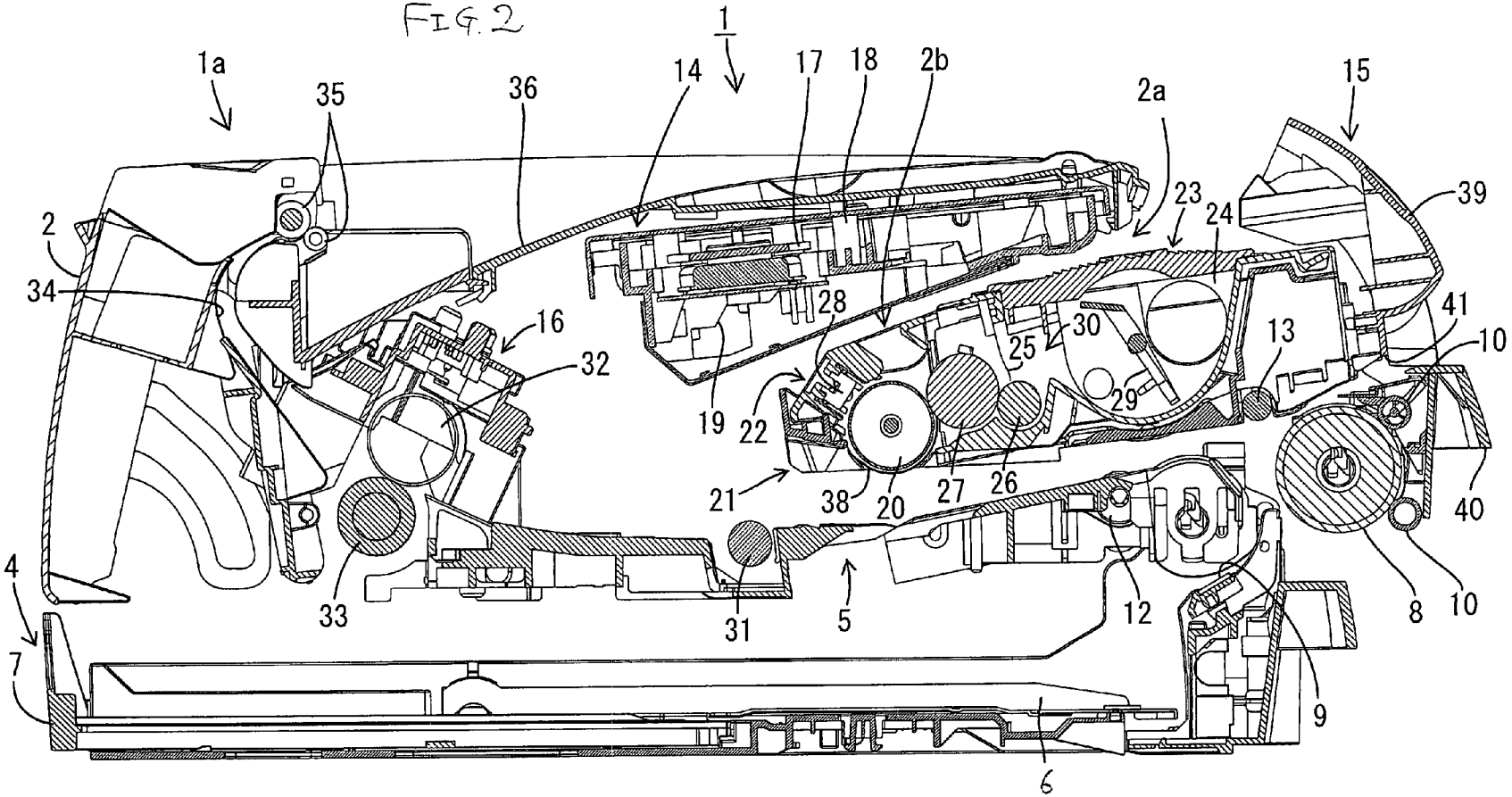
FIG. 2 is a side sectional view of the laser printer (a state that the process unit is pulled out)

FIG. 1 is a side sectional view of a laser printer 1 as an image forming apparatus according to the aspect of the invention. FIG. 2 is a side sectional view of the laser printer 1 in a state that a process unit 15 is pulled out of an apparatus main body of the laser printer 1. In the following description, that wall of the laser printer 1 through which to pull out the process unit 15 (i.e., the right-hand wall in the paper surface of FIG. 2) will be referred to as "front wall (or surface)."

As shown in FIGS. 1 and 2, the laser printer 1 is equipped with, in a main body casing 2, a feeder unit 4 for supplying a sheet (sheet material) 3, an image forming section 5 for forming a prescribed image on the sheet 3 supplied, and other units and components. The main body casing 2 is formed with a unit accommodation section 2*b* which communicates with an opening 2*a* formed in the front wall of the main body casing 2. The process unit 15 can be inserted into the unit accommodation section 2*b* through the opening 2*a* and accommodated therein detachably. In this aspect, that part of the laser printer 1 which excludes the process unit 15 functions as an "apparatus main body" and will be called "apparatus main body 1*a*" below.

(1) Configuration of Feeder Unit

The feeder unit 4 is equipped with a sheet supply cassette 7 which can accommodate sheets 3 and is attached to a bottom portion of the main body casing 2 detachably, a sheet pressing plate 6 which is provided inside the sheet supply cassette 7, a sheet feed roller 8 and a sheet feed pad 9 which are disposed above one end portion of the sheet supply cassette 7, a pair of counter rollers 10 which are disposed downstream of the sheet feed pad 9 in the sheet transport direction of the sheet 3 so as to be opposed to the sheet feed roller 8, and registration rollers 11 which are disposed downstream of the counter rollers 10 in the sheet transport direction of the sheet 3.

The sheet pressing plate 6 is configured so that sheets 3 can be stacked thereon. Its end portion that is more distant from the sheet feed roller 8 (i.e., on the side of the rear surface of the laser printer 1) is supported swingably, and its end portion that is closer to the sheet feed roller 8 (i.e., on the side of the front surface of the laser printer 1) can be rotated in the vertical direction. The sheet pressing plate 6 is urged upward by a spring (not shown) from its back side. Therefore, as the number of stacked sheets 3 increases, the sheet pressing plate 6 rotates downward against the urging force of the spring with its rear-surface-side end portion with respect to the sheet feed roller 8 as a supporting point. The sheet feed roller 8 and the sheet feed pad 9 are opposed to each other, and the sheet feed pad 9 is pressed against the sheet feed roller 8 by a spring (not shown) which is disposed on the back side of the sheet feed pad 9.

Top sheets 3 on the sheet pressing plate 6 are pressed against the sheet feed roller 8 by the spring (not shown) from the back side of the sheet pressing plate 6, held between the sheet feed roller 8 and the sheet feed pad 9 by rotation of the sheet feed roller 8, and then sent out one by one. A sheet 3 thus sent out is reversed in the traveling direction (from the forward direction to the rearward direction of the laser printer 1) while being guided by the sheet feed roller 8, the counter rollers 10, etc., and the sheet 3 is sent to the registration rollers 11. The registration rollers 11 are a pair of rollers, that is, a drive roller 12 which is provided on the main body casing 2 side and a follower roller 13 which is provided on the process unit 15 side. The sheet 3 sent from the counter rollers 10 is nipped by the drive roller 12 and the follower roller 13, subjected to prescribed registration, and then sent to the image forming section 5.

(2) Configuration of Image Forming Section

The image forming section 5 is equipped with a scanner unit 14, the process unit 15, a fixing unit 16, etc.

(a) Configuration of Scanner Unit

The scanner unit 14 is disposed above the unit accommodation section 2*b* of the main body casing 2, and is equipped with a laser light emitting section (not shown), a polygon mirror 17 which is driven rotationally, a lens 18, a reflector 19, etc. As indicated by a broken line, a laser beam emitted from the laser light emitting section according to prescribed image data passes through or is reflected by the polygon mirror 17, the lens 18, the reflector 19, etc. in order, and is finally applied to the surface of a photosensitive drum 20 of the process unit 15 (described later) to scan it at high speed.

(b) Configuration of Process Unit

Figure 3:
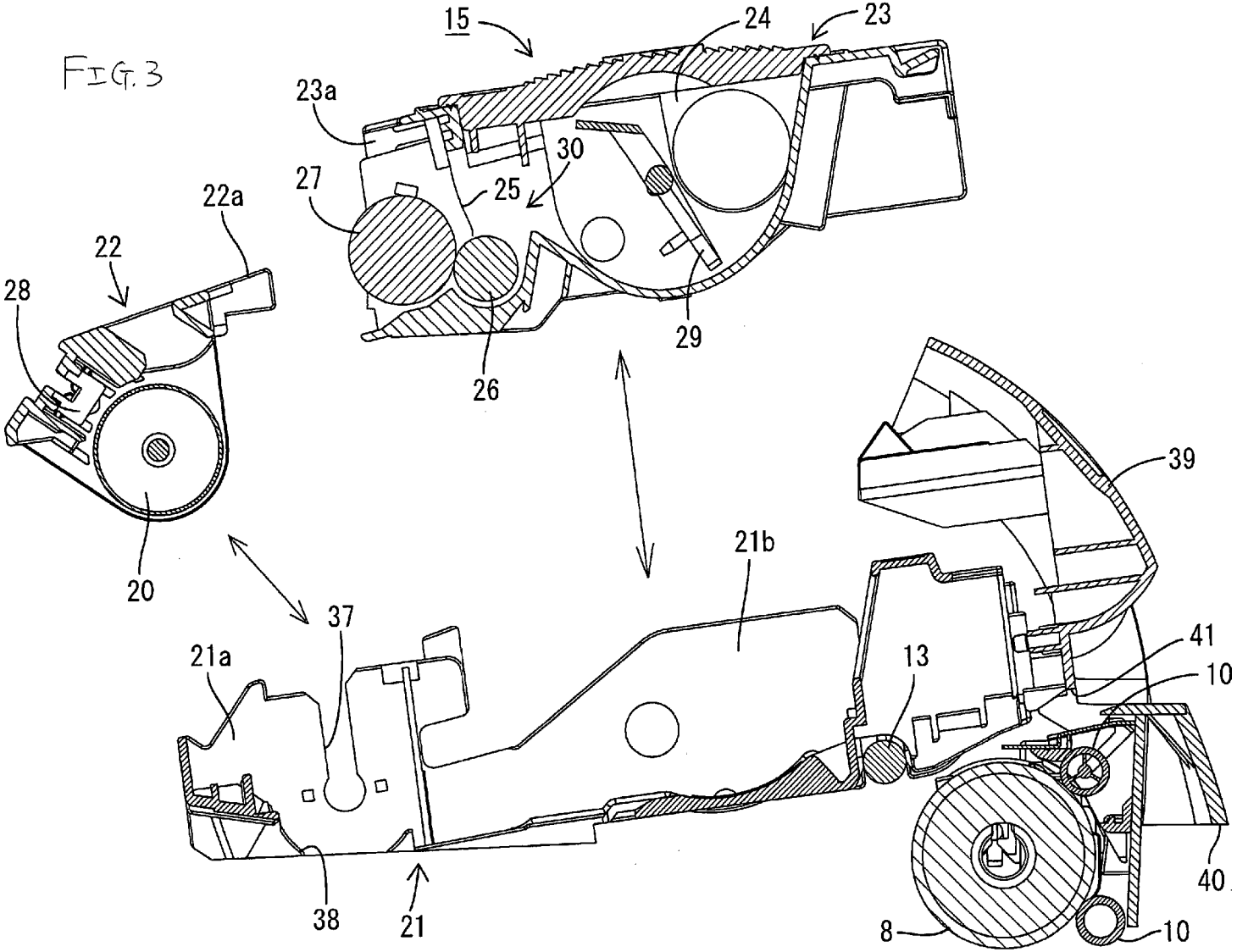
FIG. 3 is an enlarged side sectional view of the process unit.

FIG. 3 is an enlarged side sectional view of the process unit 15. As shown in the figure, the process unit 15 is configured in such a manner that a drum cartridge 22 and a development cartridge 23 are provided on a base cartridge 21 detachably.

Among those cartridges, the development cartridge 23 is equipped with a toner box 24, a layer thickness limiting blade 25, a supply roller 26, and a development roller 27, etc. A positively chargeable, non-magnetic mono-component toner as a developer is charged in the toner box 24. The toner in the toner box 24 is agitated by an agitator 29 which is provided rotatably at the center of the toner box 24, and toner is discharged through a toner supply opening 30 which is formed behind the toner box 24.

The supply roller 26 is disposed rotatably below the toner supply opening 30, and the development roller 27 is disposed rotatably so as to be opposed to the supply roller 26. The supply roller 26 and the development roller 27 are in contact with each other so as to compress each other to a certain extent.

The supply roller 26 is configured in such a manner that a metal roller shaft is covered with a roller made of a conductive foamed material. The development roller 27 is configured in such a manner that a metal roller shaft is covered with a roller made of a conductive rubber material. More specifically, the roller portion of the development roller 27 is configured in such a manner that the surface of a roller main body made of conductive urethane rubber or silicone rubber containing carbon fine particles etc. is covered with a coat layer made of urethane rubber or silicone rubber containing fluorine. A prescribed development bias, with respect to the potential of the photosensitive drum 20, is applied to the development roller 27.

The layer thickness limiting blade 25 is disposed in the vicinity of the development roller 27. The layer thickness limiting blade 25 is provided with a blade main body 37 which is a metal leaf spring member and a pressing portion 38 which is provided at the tip of the blade main body 37, is made of insulative silicone rubber, and has a semicircular cross section. The end portion, opposite to the pressing portion 38, of the blade main body 37 is supported by the development cartridge 36 at a position close to the development roller 27, and the pressing portion 38 is brought in pressure contact with the development roller 27 by the elastic force of the blade main body 37.

Toner that is discharged through the toner supply opening 30 is supplied to the development roller 27 by rotation of the supply roller 26. During that course, the toner is charged positively by friction between the supply roller 26 and the development roller 27. The toner that has been supplied onto the development roller 27 goes into the boundary between the layer thickness limiting blade 25 and the development roller 27 and is further charged there by friction as the development roller 27 is rotated. As a result, the toner comes to be carried by the development roller 27 as a thin layer having a constant thickness.

Next, the drum cartridge 22 is equipped with the photosensitive drum 20, a scorotron charger 28, etc.

As shown in FIG. 1, the photosensitive drum 20 is disposed rotatably behind the development roller 27 so as to be opposed to the development roller 27. In the photosensitive drum 20, a drum main body is grounded and its surface portion is a positively chargeable photoreceptor layer made of polycarbonate or the like.

The scorotron charger 28 is disposed above the photosensitive drum 20 with a prescribed interval so as to avoid contact with the photosensitive drum 20. The scorotron charger 28 is a positively charging one in which corona discharge occurs from a charging wire made of tungsten or the like. The scorotron charger 28 is configured so as to charge the surface of the photosensitive drum 20 positively and uniformly.

After being charged positively and uniformly by the scorotron charger 28, the surface of the photosensitive drum 20 is exposed to a laser beam coming from the scanner unit 14 (i.e., subjected to a high-speed scan), whereby an electrostatic latent image according to prescribed image data is formed. Then, as the development roller 27 is rotated, toner that is carried by the development roller 27 and charged positively is supplied to the electrostatic latent image, that is, the exposed portions (where the potential has been lowered by the exposure to the laser beam) of the surface of the photosensitive drum 20 (which was charged positively and uniformly), in a state that the development roller 27 is opposed to and is in contact with the photosensitive drum 20 and the toner comes to be carried selectively by the photosensitive drum 20. As a result, the electrostatic latent image is visualized and development is thus completed.

As shown in FIG. 1, a transfer roller 31 is disposed rotatably under the bottom surface of the unit accommodation section 2*b* so as to be opposed to the photosensitive drum 20. The visible image is transferred to a sheet 3 that has been transported by the registration rollers 11 as the sheet 3 is nipped by the photosensitive drum 20 and the transfer roller 31.

(c) Configuration of Fixing Unit

As shown in FIGS. 1 and 2, the fixing unit 16 is disposed downstream of the process unit 15 in the sheet transport direction of the sheet 3 and is equipped with a heating roller 32 and a pressing roller 33 which is pressed against the heating roller 32. The heating roller 32 is made of a metal and equipped with a halogen lamp for heating. Toner that has been transferred to a sheet 3 is thermally fused in the process unit 15 while the sheet 3 passes between the heating roller 32 and the pressing roller 33, and transports the sheet 3 to a sheet ejection path 34. The sheet 3 that has been transported to the sheet ejection path 34 is ejected onto a sheet ejection tray 36 by a pair of sheet ejection rollers 35.

2. Specific Configuration of Process Unit

As shown in FIG. 3, the base cartridge 21 is equipped with a first mounting portion 21*a* which is located close to the rear end of the base cartridge 21, has a top opening, and is to receive the drum cartridge 22 detachably. The base cartridge 21 is also equipped with a second mounting portion 21*b* which is located in front of the first mounting portion 21*a*, also has a top opening, and is to receive the development cartridge 36 detachably. The first mounting portion 21*a* has an accommodation space that conforms to the shape of the drum cartridge 22. Cuts as bearing portions 37 (only the left-hand one is shown in the figure) are formed in the right and left side walls, respectively, and end portions of the roller shaft of the photosensitive drum 20 are inserted into the respective bearing portions 37, whereby the drum cartridge 22 is positioned with respect to the base cartridge 21. A through-hole 38 for exposing the bottom surface of the photosensitive drum 20 in a state that the drum cartridge 22 is mounted is formed through the bottom wall of the first mounting portion 21*a*. The photosensitive drum 20 and the transfer roller 31 are opposed to each other through the through-hole 38 so as to form a nip position.

On the other hand, the second mounting section 21*b* has an accommodation space that conforms to the shape of the development cartridge 23. For example, the development cartridge 23 is positioned with respect to the base cartridge 21 by an engaging portion (not shown). As shown in FIGS. 1-3, an engagement portion 22*a* which is located at the front end of the drum cartridge 22 is engaged with an engagement subject portion 23*a* which is located at the rear end of the development cartridge 23, whereby the development roller 27 and the photosensitive drum 20 are opposed to each other in a regular state and prevented from deviating from such positions.

As shown in FIG. 1, a cover 39 for closing the opening 2*a* of the main body casing 2 in a state that the process unit 15 is inserted in the unit accommodation section 2*b* is provided integrally with the base cartridge 21 at the front end of the base cartridge 21. The cover 39 is formed with a handle 40 at a bottom-front position, and the base cartridge 21 can be pulled out of the apparatus main body 1*a* by gripping the handle 40. A sheet insertion hole 41 extending in the right-left direction is formed through the front wall of the base cartridge 21 above the handle 40. A sheet 3 can be inserted through the sheet insertion hole 41 manually, for example. A sheet 3 inserted through the sheet insertion hole 41 is likewise transported to the registration rollers 11 by the sheet feed roller 8 and subjected to image formation by the image forming section 5.

Further, the base cartridge 21 is provided with the above-mentioned sheet feed roller 8 and counter rollers 10 at a the bottom-front position, more specifically, behind the sheet insertion hole 41. That is, the sheet feed roller 8 and the counter rollers 10 are pulled out of the apparatus main body 1*a* together with the process unit 15. This structure is effective in miniaturizing the laser printer 1 in the vertical direction while enabling attachment/detachment of the process unit 15. More specifically, as shown in FIG. 1, the height Y of the bottom surface of the photosensitive drum 20 is set lower than the height X of the top surface of the sheet feed roller 8 in a state that the process unit 15 is inserted completely, whereby the process unit 15 is located at as low a position as possible and the vertical size of the laser printer 1 is thereby reduced. Since the sheet feed roller 8 and the counter rollers 10 are pulled out of the apparatus main body 1*a* together with the process unit 15, the process unit 15 can be attached and detached smoothly (see FIGS. 1 and 2).

Figure 4:
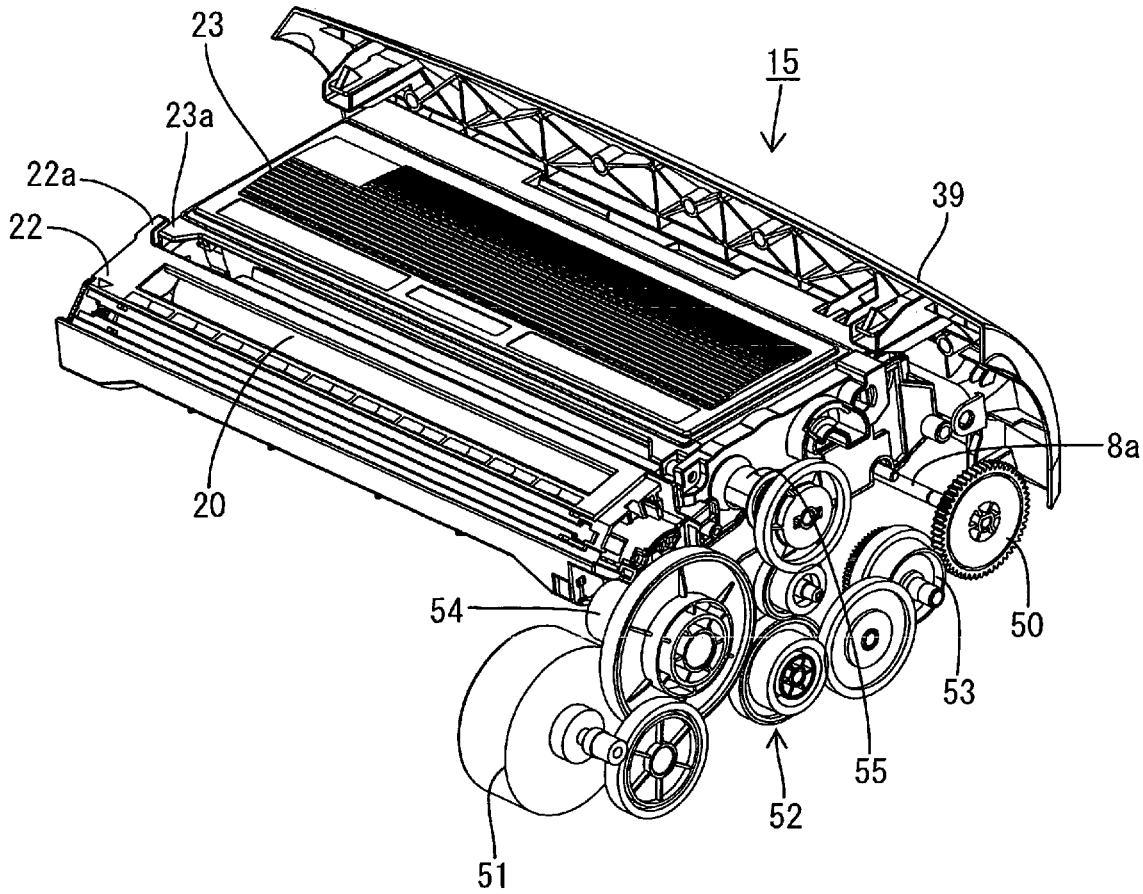
FIG. 4 is a perspective view showing a state that a drive gear on a process unit side is engaged with drive gears on an apparatus main body side.
Figure 5:
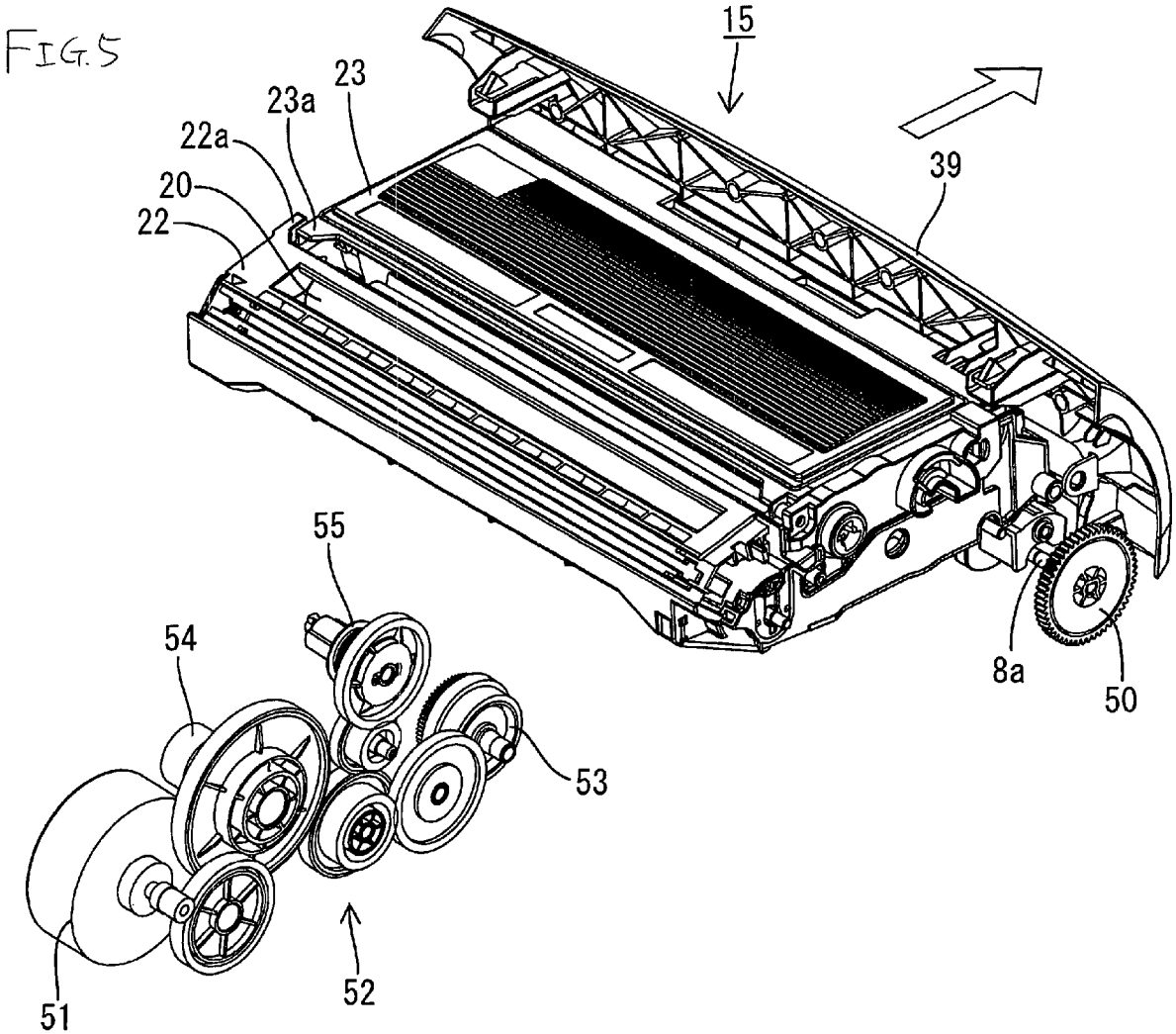
FIG. 5 is a perspective view showing a state that the drive gear on the process unit side is disengaged from the drive gears on the apparatus main body side.

3. Engagement/Disengagement of Gears when the Process Unit is Attached or Detached FIGS. 4 and 5 are perspective views showing the process unit 15 and a gear mechanism for driving the sheet feed roller 8 etc. rotationally.

As shown in the figures, a roller shaft end portion 8*a* of the sheet feed roller 8 projects on the right side of the process unit 15 and the tip portion of the roller shaft end portion 8*a* is fitted in an input gear 50 which rotates together with the roller shaft end portion 8*a*. On the other hand, the apparatus main body 1*a* is equipped with a driving motor 51 and a main-body-side gear mechanism 52 which is driven rotationally receiving drive power from the driving motor 51. As shown in FIG. 4, an output gear 53 which is located at the front end of the main-body-side gear mechanism 52 is engaged with the input gear 50, whereby drive power is transmitted from the driving motor 51 to the roller shaft end portion 8*a* and the sheet feed roller 8 is driven rotationally.

Therefore, when the process unit 15 is pulled out of the apparatus main body 1*a* (see FIG. 2), the output gear 53 is disengaged from the input gear 50 and the sheet feed roller 8 is rendered free. The main-body-side gear mechanism 52 includes a gear 54 for driving the photosensitive drum 20 rotationally, a gear 55 for driving the development roller 27 rotationally, etc.

4. Advantages of Aspect (1) In the aspect, the cover 39 for closing the opening 2*a* of the main body casing 2 is provided integrally with the process unit 15. Therefore, the process unit 15 can be taken out together with the cover 39 by pulling out the process unit 15 by gripping the handle 40 which is attached to the process unit 15.

(2) In the process unit 15, the drum cartridge 22 and the development cartridge 23 can be attached to and detached from the base cartridge 21 individually. Therefore, if, for example, toner replacement is necessary because the toner has been used up or has deteriorated, the process unit 15 can be inserted into the apparatus main body 1*a* again after replacing only the development cartridge 23. If, for example, the photosensitive drum 20 has been damaged and requires replacement, it is sufficient to replace only the drum cartridge 22.

(3) Further, such a transport unit as the sheet feed roller 8 which may become obstacles in a process of attaching or detaching the process unit 15 are attached to the process unit 15 and pulled out of the apparatus main body 1*a* together with the process unit 15. Therefore, as described above, the vertical size of the laser printer 1 can be miniaturized.

(4) Still further, when the process unit 15 is pulled out, the input gear 50 which rotates together with the sheet feed roller 8 is disengaged from the output gear 53 (which is provided on the apparatus main body 1*a*) and is thereby rendered free. Therefore, even if a jam of a sheet 3 has occurred in the sheet transport path along part of the circumferential surface of the sheet feed roller 8, the jammed sheet 3 can be removed easily by making the sheet feed roller 8 free by pulling out the process unit 15.

<Aspect 2>

Figure 6:
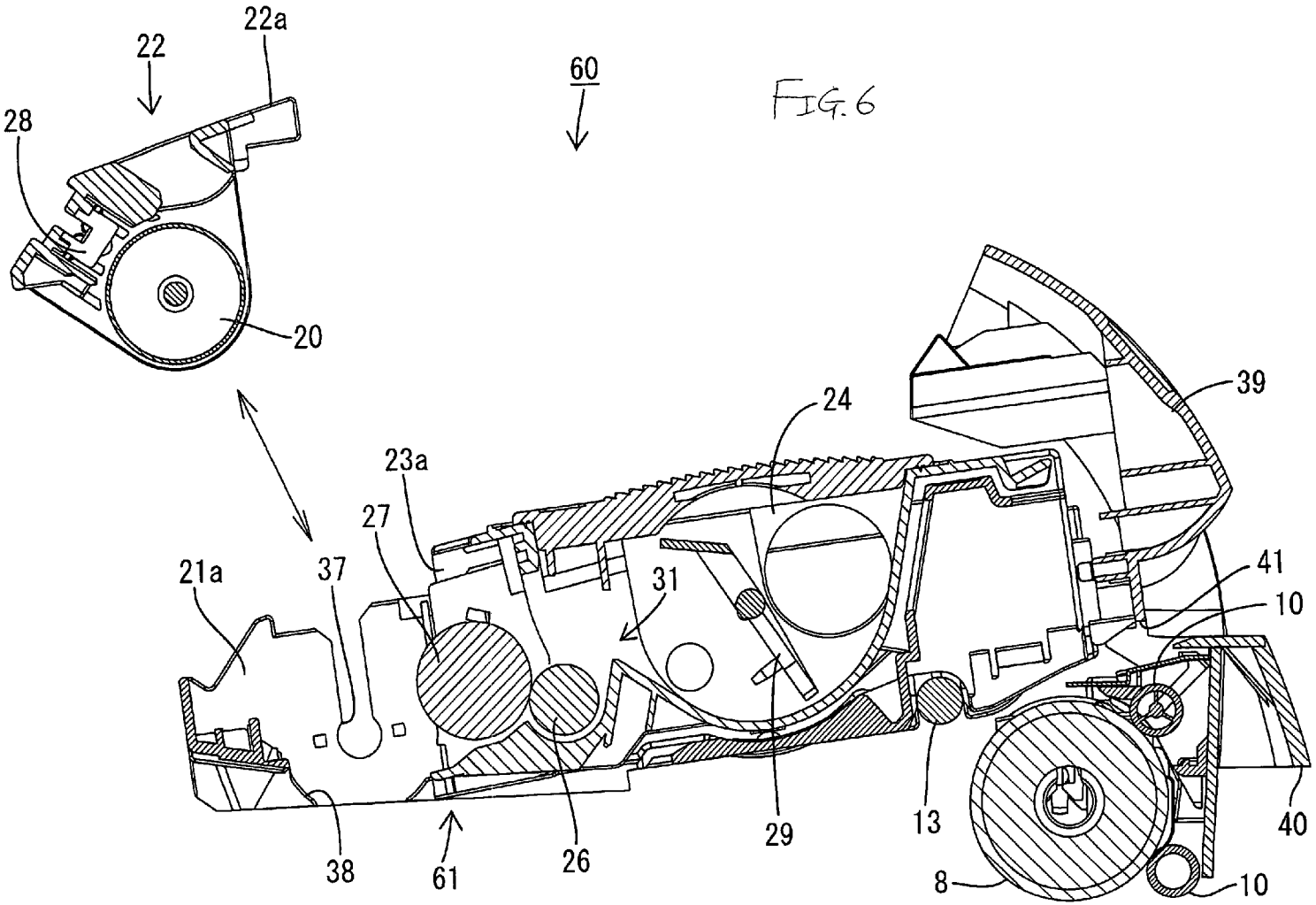
FIG. 6 is an enlarged side sectional view of a process unit according to a second aspect.

FIG. 6 shows a second aspect. This aspect is the same as the first aspect except for the configuration of the process unit. Therefore, units and components having the same ones in the first aspect will be given the same reference symbols as in the first aspect, and redundant descriptions will be omitted. Only different points will be described below.

As shown in FIG. 6, in a process unit 60 according to this aspect, the toner box 24, the layer thickness limiting blade 25, the supply roller 26, and the development roller 27 are provided integrally with a base cartridge 61 and cannot be detached from the base cartridge 61.

This configuration can increase the positioning accuracy of the process unit 60 with respect to the apparatus main body 1*a* though the supply roller 26 and the development roller 27 cannot be detached from the base cartridge 61.

<Aspect 3>

Figure 7:
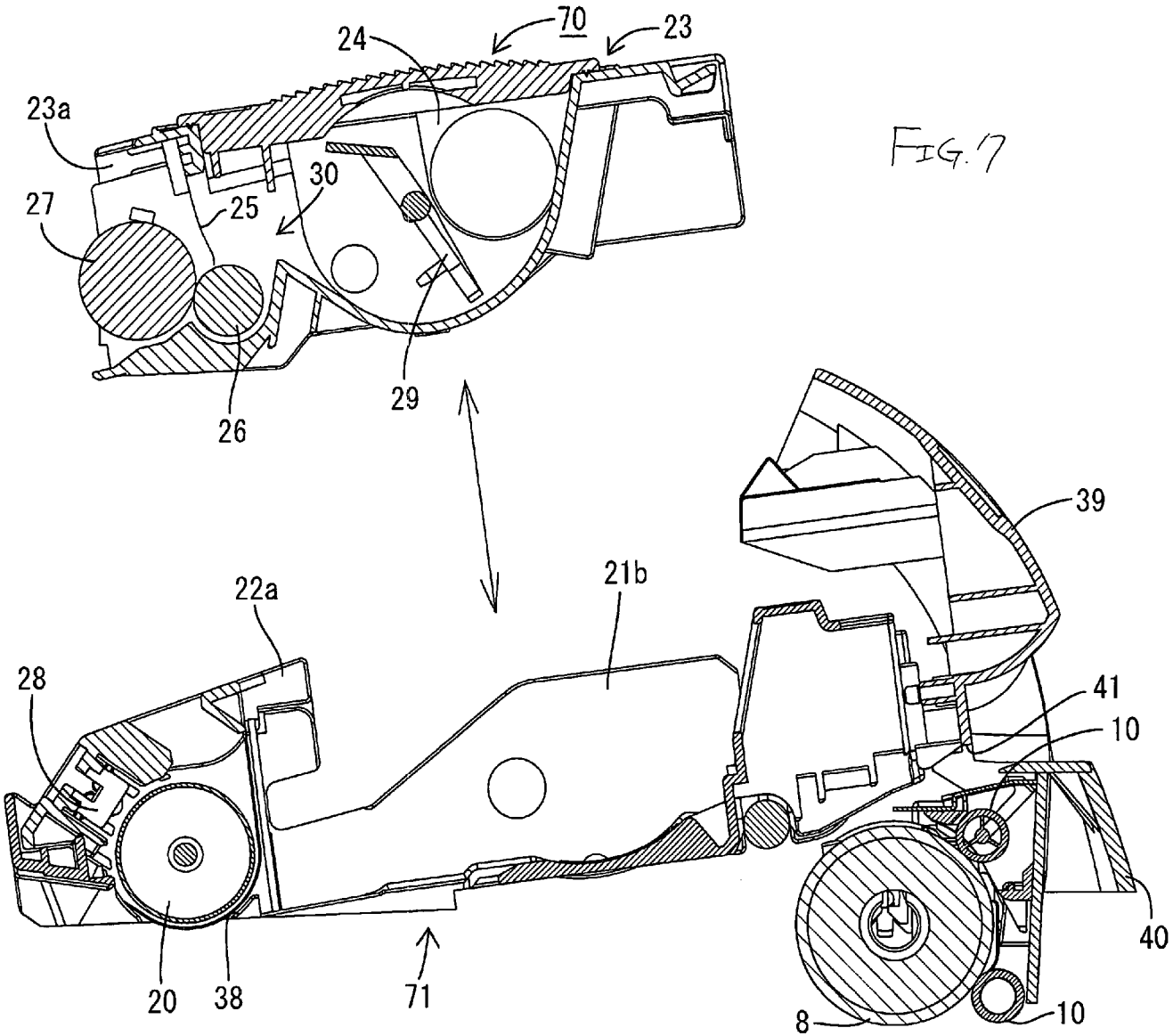
FIG. 7 is an enlarged side sectional view of a process unit according to a third aspect.

FIG. 7 shows a third aspect. This aspect is the same as the first aspect except for the configuration of the process unit. Therefore, units and components having the same ones in the first aspect will be given the same reference symbols as in the first aspect, and redundant descriptions will be omitted. Only different points will be described below.

As shown in FIG. 7, in a process unit 70 according to this aspect, the photosensitive drum 20 and the scorotron charger 28 are provided integrally with a base cartridge 71 and cannot be detached from the base cartridge 71.

This configuration can increase the positioning accuracy of the photosensitive drum 20 with respect to the transfer roller 31 in the side of the apparatus main body 1*a* though it cannot be detached from the base cartridge 71.

<Other Aspects>

The invention is not limited to the aspects that have been described above with reference to the drawings. For example, the following aspects are also included in the technical scope of the invention. And various modifications other than the following aspects are possible without departing from the spirit and scope of the invention.

(1) The first aspect may be modified in such a manner that the drum cartridge 22 and the development cartridge 23 are integrated with each other so as to be attached to and detached from the base cartridge 21 together. In this case, the positional accuracy of the development roller 27 and the photosensitive drum 20 can be kept high.

(2) The transport unit is only required to be provided on the side of the aperture of the apparatus main body and to transport a sheet material to the process unit. That is, the transport unit need not be a means for transporting a sheet material accommodated in the sheet material accommodation unit which is disposed under the unit accommodation section, and may be, for example, a dedicated roller for transporting a sheet 3 that is inserted through the sheet insertion hole 41 in the above aspects.

(3) Although in the above aspects the sheet feed roller 8 is provided as a transport roller, the same purpose may be attained by a gear that rotates together with, for example, one of the counter rollers 10, one of the registration rollers 11, or the like as long as it is engaged with an apparatus-main-body-side drive gear.

As was described, according to the above-described aspect, the process unit has an image carrier accommodation unit that accommodates an image carrier, and a base unit on which the developer container and the image carrier accommodation unit are mounted, the base unit being integrally provided with the cover; and the developer container and the image carrier accommodation unit are capable of being attached to and detached from the base unit.

The image carrier is not limited to a photosensitive drum (photoreceptor body) and may be an intermediate transfer body.

The developer container and the image carrier accommodation unit may be either separate units that can be attached to and detached from the base unit independently or an integral unit (i.e., they can be attached to and detached from the base unit together).

Alternatively, the process unit has an image carrier accommodation unit that accommodates an image carrier, and a base unit on which the developer container and the image carrier accommodation unit are mounted, the base unit being integrally provided with the cover; and the developer container is integrally provided with the base unit and the image carrier accommodation unit is capable of being attached to and detached from the base unit.

Alternatively, the process unit has an image carrier accommodation unit that accommodates an image carrier, and a base unit on which the developer container and the image carrier accommodation unit are mounted, the base unit being integrally provided with the cover; and the developer container is capable of being attached to and detached from the base unit and the image carrier accommodation unit is integrally provided with the base unit.

In these configurations, at least one of the developer container and the image carrier accommodation unit can be attached to and detached from the base unit, which makes it possible to replace only a minimum number of components (expendables) such as the developer and the image carrier that require replacement. In general, the developer and the image carrier have different lives. Therefore, it is desirable that the developer container and the image carrier accommodation unit be able to be attached to and detached from the base unit independently.

In addition, the image forming apparatus further includes: a sheet material accommodation unit disposed under the unit accommodation section, for accommodating a sheet material; and a transport unit disposed on a side of the opening, for transporting the sheet material accommodated in the sheet material accommodation unit to the process unit; wherein the transport unit is supported by the process unit and is capable of being pulled out of the apparatus main body together with the process unit.

The sheet material includes a sheet of paper and an OHP sheet as recording media.

Image forming apparatus currently show a tendency of size reduction particularly in the vertical direction. Therefore, to secure a space through which to pull out the process unit, the transport means which is provided on the side of the opening may become an obstacle. In view of this, in this configuration, the transport means which may become an obstacle is also attached to the process unit and is pulled out together with the process unit.

Also, the transport unit has a gear mechanism that receives drive power when engaged with a drive gear provided in the apparatus main body, and a transport roller for transporting the sheet material when rotated being driven by the gear mechanism; and the gear mechanism is disengaged from the drive gear when the process unit is pulled out of the apparatus main body.

In addition, the image forming apparatus further includes: a separation pad and a separation roller opposed to each other, for separating sheet materials supplied from the sheet material accommodation unit into single sheet material and transporting the single sheet material one by one, the separation roller serving as the transport roller.

In this configuration, when the process unit is pulled out of the apparatus main body, the gear mechanism is disengaged from the drive gear and the transport roller is rendered free. This facilitates work of removing, from the transport path, a sheet that has been jammed in the middle of a transport. The separation roller and the separation pad for separating sheet materials into single ones provide particularly strong nip force. Therefore, it is particularly desirable to render the separation roller free in pulling out the process unit.

Moreover, a bottom surface of the image carrier is lower than a top surface of the transport roller in a state that the process unit is accommodated in the unit accommodation section.

In this configuration, the bottom surface of the image carrier is lower than the top surface of the transport roller, whereby the size of the image forming apparatus is reduced in the vertical direction.

What is claimed is:

1. An image forming apparatus comprising:

a process unit including a developer container for containing a developer, and an image carrier accommodation unit that accommodates an image carrier;

an apparatus main body having an opening and including, a unit accommodation section into which the process unit is inserted through the opening and detachably accommodated, a scanner unit that exposes the image carrier, and a roller which is configured to oppose the image carrier; and a cover for closing the opening in a state that the process unit is accommodated in the unit accommodation section, the cover being integrally provided with the process unit, wherein the process unit includes a base unit on which the developer container and the image carrier accommodation unit are mounted, the base unit being integrally provided with the cover; and the developer container and the image carrier accommodation unit are capable of being attached to and detached from the base unit.

2. The image forming apparatus according to claim 1, wherein the process unit includes a base unit on which the developer container and the image carrier accommodation unit are mounted, the base unit being integrally provided with the cover; and the developer container is integrally provided with the base unit and the image carrier accommodation unit is capable of being attached to and detached from the base unit.

3. The image forming apparatus according to claim 1, further comprising:

a sheet material accommodation unit disposed under the unit accommodation section, for accommodating a sheet material; and a transport unit disposed on a side of the opening, for transporting the sheet material accommodated in the sheet material accommodation unit to the process unit;

wherein the transport unit is supported by the process unit and is capable of being pulled out of the apparatus main body together with the process unit.

4. The image forming apparatus according to claim 3, wherein the transport unit comprises a gear mechanism that receives drive power when engaged with a drive gear provided in the apparatus main body, and a transport roller for transporting the sheet material when rotated being driven by the gear mechanism; and the gear mechanism is disengaged from the drive gear when the process unit is pulled out of the apparatus main body.

5. The image forming apparatus according to claim 4, further comprising a separation pad and a separation roller opposed to each other, for separating sheet materials supplied from the sheet material accommodation unit into single sheet material and transporting the single sheet material one by one, the separation roller serving as the transport roller.

6. The image forming apparatus according to claim 4, wherein a bottom surface of the image carrier is lower than a top surface of the transport roller in a state that the process unit is accommodated in the unit accommodation section.

7. The image forming apparatus according to claim 1, wherein the process unit is installable on and detachable from the apparatus main body.

8. An image forming apparatus comprising:

a process unit including a developer container for containing a developer, and an image carrier accommodation unit that accommodates an image carrier;

an apparatus main body having an opening and including, a unit accommodation section into which the process unit is inserted through the opening and detachably accommodated, a scanner unit that exposes the image carrier, and a roller which is configured to oppose the image carrier; and a cover for closing the opening in a state that the process unit is accommodated in the unit accommodation section, the cover being integrally provided with the process unit, wherein the process unit includes a base unit on which the developer container and the image carrier accommodation unit are mounted, the base unit being integrally provided with the cover; and the developer container is capable of being attached to and detached from the base unit and the image carrier accommodation unit is integrally provided with the base unit.

9. An image forming apparatus comprising:

a process unit comprising a developer container for containing a developer and an image carrier accommodation unit that accommodates an image carrier;

an apparatus main body comprising an opening and a unit accommodation section into which the process unit is inserted through the opening and detachably accommodated;

a cover for closing the opening in a state that the process unit is accommodated in the unit accommodation section, the cover being integrally provided with the process unit; and a base unit on which the developer container and the image carrier accommodation unit are mounted, the base unit being integrally provided with the cover, wherein the developer container is integrally provided with the base unit and the image carrier accommodation unit is capable of being attached to and detached from the base unit.

10. An image forming apparatus comprising:

a process unit comprising a developer container for containing a developer;

an apparatus main body comprising an opening and a unit accommodation section into which the process unit is inserted through the opening and detachably accommodated;

a cover for closing the opening in a state that the process unit is accommodated in the unit accommodation section, the cover being integrally provided with the process unit;

a sheet material accommodation unit disposed under the unit accommodation section, for accommodating a sheet material; and a transport unit disposed on a side of the opening, for transporting the sheet material accommodated in the sheet material accommodation unit to the process unit, wherein the transport unit is supported by the process unit and is capable of being pulled out of the apparatus main body together with the process unit.

11. The image forming apparatus according to claim 10, wherein the transport unit comprises:

a gear mechanism that receives drive power when engaged with a drive gear provided in the apparatus main body; and a transport roller for transporting the sheet material when rotated being driven by the gear mechanism;

wherein the gear mechanism is disengaged from the drive gear when the process unit is pulled out of the apparatus main body.

12. The image forming apparatus according to claim 11, further comprising a separation pad and a separation roller opposed to each other, for separating sheet materials supplied from the sheet material accommodation unit into single sheet material and transporting the single sheet material one by one, wherein the separation roller serves as the transport roller.

13. The image forming apparatus according to claim 11, wherein a bottom surface of the image carrier is lower than a top surface of the transport roller in a state that the process unit is accommodated in the unit accommodation section.

* * * * *